US011699395B2

(12) United States Patent
Baek et al.

(10) Patent No.: US 11,699,395 B2
(45) Date of Patent: Jul. 11, 2023

(54) DISPLAY DEVICE AND METHOD OF DRIVING THE SAME

(71) Applicant: Samsung Display Co., Ltd., Yongin-si (KR)

(72) Inventors: Yun Ki Baek, Yongin-si (KR); Joon Chul Goh, Yongin-si (KR); Jung Taek Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/356,292

(22) Filed: Jun. 23, 2021

(65) Prior Publication Data

US 2022/0157243 A1 May 19, 2022

(30) Foreign Application Priority Data

Nov. 16, 2020 (KR) ..... 10-2020-0152881

(51) Int. Cl.
*G09G 3/3241* (2016.01)

(52) U.S. Cl.
CPC ..... *G09G 3/3241* (2013.01); *G09G 2310/061* (2013.01); *G09G 2310/08* (2013.01); *G09G 2360/142* (2013.01)

(58) Field of Classification Search
None
See application file for complete search history.

(56) References Cited

U.S. PATENT DOCUMENTS

| | | | | |
|---|---|---|---|---|
| 9,269,294 | B2 | 2/2016 | Eom et al. | |
| 2011/0279437 | A1* | 11/2011 | Komiya | G09G 3/3233 345/212 |
| 2015/0109278 | A1* | 4/2015 | Kim | G09G 3/3233 345/82 |
| 2019/0197959 | A1* | 6/2019 | Noh | G09G 3/3266 |
| 2019/0378459 | A1* | 12/2019 | Kim | G09G 3/3291 |

FOREIGN PATENT DOCUMENTS

| | | | |
|---|---|---|---|
| KR | 10-0923347 | B1 | 10/2009 |
| KR | 10-1548495 | B1 | 9/2015 |
| KR | 10-1671514 | B1 | 11/2016 |
| KR | 10-2032358 | B1 | 10/2019 |

* cited by examiner

*Primary Examiner* — Aneeta Yodichkas
(74) *Attorney, Agent, or Firm* — Lewis Roca Rothgerber Christie LLP

(57) ABSTRACT

A display device according to some embodiments includes pixels divided into pixel rows arranged in a horizontal direction, and including a light emitting element, and a first transistor for applying a drive current to the light emitting element, and a sensing driver configured to receive a sensing value extracted from one or more of the pixels, wherein at least one pixel row of the pixel rows is configured to be driven in one frame including an emission period in which the light emitting element emits light after a data voltage is applied to the pixels, and an active sensing period for sensing a characteristic of the first transistor.

20 Claims, 10 Drawing Sheets

DISPLAY DEVICE AND METHOD OF DRIVING THE SAME

CROSS-REFERENCE TO RELATED APPLICATION

This application claims priority to, and the benefit of, Korean Patent Application No. 10-2020-0152881 filed in the Korean Intellectual Property Office on Nov. 16, 2020, the entire contents of which are incorporated herein by reference.

BACKGROUND

1. Field

The present disclosure relates to a display device, and a method of driving the display device.

2. Description of the Related Art

With increasing interest in information display, and increasing demand for use of portable information media, there are increasing demand and commercialization for display devices.

SUMMARY

The present disclosure provides a display device capable of reducing a sensing time, and a method of driving the display device.

Some embodiments of the present disclosure provide a display device including pixels divided into pixel rows arranged in a horizontal direction, and including a light emitting element, and a first transistor for applying a drive current to the light emitting element, and a sensing driver configured to receive a sensing value extracted from one or more of the pixels, wherein at least one pixel row of the pixel rows is configured to be driven in one frame including an emission period in which the light emitting element emits light after a data voltage is applied to the pixels, and an active sensing period for sensing a characteristic of the first transistor.

Others of the pixel rows may be configured to be driven to include only the emission period in the one frame.

When a still image is displayed for a threshold amount of time or longer during a plurality of frame periods, a frame after the still image may be driven so that the at least one pixel row includes the emission period and the active sensing period.

At least one of the plurality of frame periods may include a blank sensing period for sensing the characteristic of the first transistor.

When a change in mobility of the first transistor sensed during the blank sensing period is greater than a threshold mobility change, a frame after the blank sensing period may be driven to include the emission period and the active sensing period.

The sensing driver may be configured to detect a change in a threshold voltage and a change in mobility of the first transistor by using a sensing value sensed during the blank sensing period, and to calculate a compensation value based on the detected change.

The display device may further include a data driver configured to apply a data voltage to the pixels, and a timing controller configured to supply the data driver with image data compensated based on externally supplied input image data.

The sensing driver may be configured to detect a mobility change of the first transistor by using a sensing value sensed during the active sensing period, and to calculate a compensation value based on the detected mobility change, wherein the timing controller is configured to generate compensated image data by reflecting the compensation value provided from the sensing driver.

The display device may further include a gamma voltage driver configured to store a gamma voltage table for compensating for the data voltage in correspondence with a length of the active sensing period during the one frame.

The sensing driver may be configured to detect a mobility change of the first transistor by using a sensing value sensed during the active sensing period, and to calculate a compensation value based on the detected mobility change, and wherein the timing controller is configured to generate compensated image data by reflecting the compensation value provided from the sensing driver.

Other embodiments of the present disclosure provide a display device including pixels divided into pixel rows arranged in a horizontal direction, and including a light emitting element, and a first transistor for applying a drive current to the light emitting element, and a sensing driver configured to receive a sensing value extracted from the pixels, wherein at least one pixel row of the pixel rows is configured to be driven to include an emission period in which the light emitting element emits light after a data voltage is applied to the pixels, and an active sensing period for sensing a characteristic of the first transistor during a first frame, wherein other pixel rows of the pixel rows are driven to include only the emission period in the first frame, and wherein at least one of the other pixel rows is driven to include the emission period and the active sensing period in a second frame.

Others of the other pixel rows may be configured to be driven to include only the emission period in the second frame.

The sensing driver may be configured to detect a mobility change of the first transistor by using a sensing value sensed in the active sensing period.

Other embodiments of the present disclosure provide a method of driving a display device including a display panel including pixel rows of pixels arranged in a horizontal direction, and a sensing driver configured to receive sensing values extracted from the pixels, the method including driving at least one pixel row of the pixel rows to include an emission period in which a light emitting element emits light after a data voltage is applied, and an active sensing period for sensing a characteristic of a first transistor during one frame, wherein the pixels include a light emitting element, the first transistor configured to apply a drive current to the light emitting element, connected between a second node and a first power line for receiving a first drive voltage, and including a gate electrode connected to a first node, a second transistor configured connected between a data line and the gate electrode of the first transistor, and including a gate electrode connected to a first scan line, a third transistor connected between a sensing line and the second node, and including a gate electrode connected to a second scan line, a fourth transistor connected between the second node and the light emitting element, and including a gate electrode connected to an emission control line, and a switching capacitor connected between the gate electrode of the first transistor and the second node.

The second transistor and the third transistor may be configured to be in a turn-off state, and the fourth transistor is configured to be turned on, during the emission period.

The second transistor and the fourth transistor may be configured to be in a turn-off state, and the third transistor is configured to be turned on, during the active sensing period.

The sensing driver may be configured to extract a sensing value corresponding to a current flowing to the second node through the first transistor during the active sensing period.

At least one frame period of a plurality of frame periods may include a blank sensing period for sensing the characteristic of the first transistor.

The second transistor and the third transistor may be configured to be turned on during the blank sensing period.

When a change in mobility of the first transistor sensed during the blank sensing period is greater than a threshold mobility change, a frame after the blank sensing period may include the emission period and the active sensing period.

According to some embodiments, pixel compensation may be accelerated by reducing a sensing time, and thus, spots and afterimages may be effectively reduced.

According to some embodiments, even when an active sensing period is included in an active period, a gamma voltage corresponding to a length of the active sensing period may be reflected in one or more pixel rows to be sensed during one frame, and thus, a display luminance may be kept constant.

Aspects of the embodiments are not limited to the content described above, and more various aspects are included in the present specification.

BRIEF DESCRIPTION OF THE DRAWINGS

The above and other aspects of embodiments of the disclosure will be more apparent from the following description taken in conjunction with the accompanying drawings, in which.

DETAILED DESCRIPTION

Figure 1:
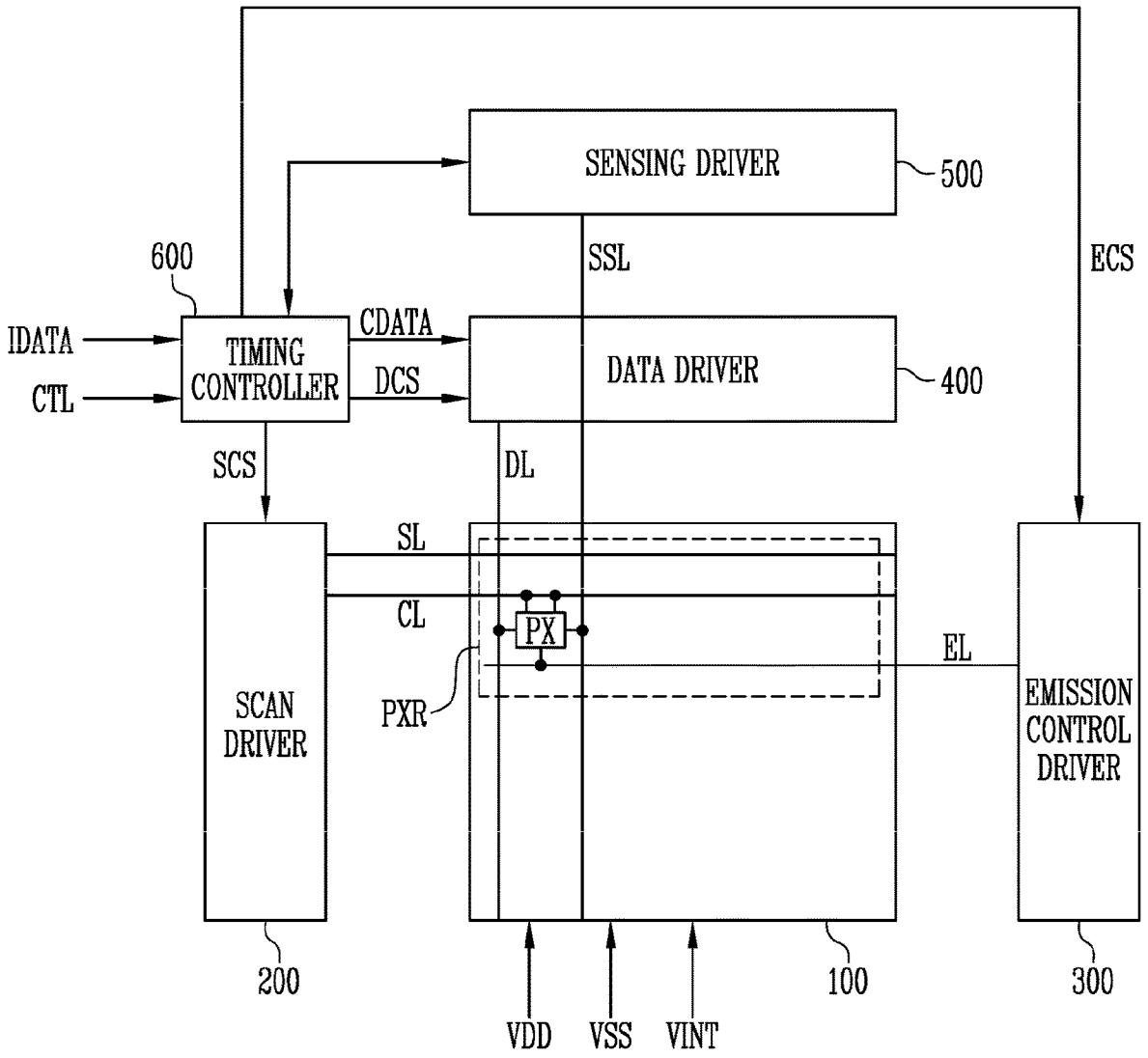
FIG. 1 is a block diagram schematically illustrating a display device according to some embodiments.

Aspects of some embodiments of the present disclosure and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects of the present disclosure to those skilled in the art. Accordingly, processes, elements, and techniques that are not necessary to those having ordinary skill in the art for a complete understanding of the aspects of the present disclosure may not be described.

Unless otherwise noted, like reference numerals, characters, or combinations thereof denote like elements throughout the attached drawings and the written description, and thus, descriptions thereof will not be repeated. Further, parts not related to the description of the embodiments might not be shown to make the description clear.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that when an element, layer, region, or component is referred to as being "formed on," "on," "connected to," or "coupled to" another element, layer, region, or component, it can be directly formed on, on, connected to, or coupled to the other element, layer, region, or component, or indirectly formed on, on, connected to, or coupled to the other element, layer, region, or component such that one or more intervening elements, layers, regions, or components may be present. For example, when a layer, region, or component is referred to as being "electrically connected" or "electrically coupled" to another layer, region, or component, it can be directly electrically connected or coupled to the other layer, region, and/or component or intervening layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure. The description of an element as a "first" element may not require or imply the presence of a second element or other elements. The terms "first", "second", etc. may also be used herein to differentiate different categories or sets of elements. For conciseness, the terms "first", "second", etc. may represent "first-category (or first-set)", "second-category (or second-set)", etc., respectively.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When one or more embodiments may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate.

Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, a display device according to some embodiments of the present disclosure will be described with reference to the drawings related to the embodiments of the present disclosure.

FIG. 1 is a block diagram schematically illustrating a display device according to some embodiments.

Referring to FIG. 1, a display device according to some embodiments may include a display unit/display panel 100, a scan driver 200, an emission control driver 300, a data driver 400, a sensing unit/sensing driver 500, and a timing controller 600.

The display device may be a flat display device, a flexible display device, a curved display device, a foldable display device, a bendable display device, or a stretchable display device. In addition, the display device may be applied to a transparent display device, a head-mounted display device, a wearable display device, and so on. In addition, the display device may be applied to various electronic devices such as smart phones, tablets, smart pads, TVs, and monitors.

The display device may be implemented as a self-luminous display device including a plurality of self-luminous elements. For example, the display device may be a display device including organic light emitting elements, a display device including inorganic light emitting elements, or a display device including light emitting elements composed of a combination of an inorganic material and an organic material. However, this is an example, and the display device may also be implemented as a quantum dot display device or so on.

In some embodiments, the display device may be driven to include a data write period in which a data voltage is written to pixels PX to display an image, an emission period in which a light emitting element emits light, an active sensing period for sensing characteristics of drive transistors included in each of the pixels PX, a blank sensing period, and so on.

The display panel 100 includes a pixel PX connected to a data line DL, a first scan line SL, a second scan line CL, an emission control line EL, and a sensing line SSL. The display panel 100 may include a plurality of pixels PX connected to a plurality of data lines DL, a plurality of first scan lines SL, a plurality of second scan lines CL, a plurality of emission control lines EL, and a plurality of sensing lines SSL, respectively.

The plurality of pixels PX may be divided into pixel rows PXR in which pixels are arranged in a horizontal direction, and the display panel 100 may include the plurality of pixel rows PXR.

The pixel PX may receive a first drive voltage VDD, a second drive voltage VSS, and an initialization voltage VINT from the outside. A detailed configuration of the pixel PX will be described below with reference to FIG. 2.

The scan driver 200 receives a scan control signal SCS from the timing controller 600. The scan driver 200 may supply a first scan signal to each of the first scan lines SL in response to the scan control signal SCS, and may supply a second scan signal to each of the second scan lines CL.

The scan driver 200 may sequentially supply the first scan signal to the first scan lines SL. For example, the first scan signal may be set as a gate-on voltage to turn on a transistor included in the pixel PX. In addition, the first scan signal may be used to apply a data signal (or data voltage) to the pixel PX.

In addition, the scan driver 200 may supply the second scan signal to the second scan lines CL. For example, the second scan signal may be set as the gate-on voltage to turn on the corresponding transistor included in the pixel PX. The second scan signal may be used to sense (or extract) a drive current flowing through the pixel PX or to apply an initialization voltage VINT to the pixel PX.

Meanwhile, although FIG. 1 illustrates that one scan driver 200 outputs both the first scan signal and the second scan signal, the present disclosure is not limited thereto, and in some embodiments, the scan driver 200 may include a first scan driver that supplies the first scan signal to the display panel 100, and a second scan driver that supplies a second scan signal to the display panel 100. That is, the first scan driver and the second scan driver may have different configurations.

The emission control driver 300 receives the emission control signal ECS from the timing controller 600. The emission control driver 300 may supply an emission signal to the emission control lines EL in response to the emission control signal ECS.

The emission control driver 300 may supply emission signals to the emission control lines EL, respectively. For example, the emission signal may be set as a gate-on voltage to turn on a corresponding transistor included in the pixel PX. In addition, the emission signal may be used for the light emitting element, which is included in the pixel PX, to emit light.

The data driver 400 receives the data control signal DCS from the timing controller 600. During a data write period, the data driver 400 may supply the display panel 100 with a data signal (or data voltage) for displaying an image based on compensated image data CDATA. In addition, during the blank sensing period, the data driver 400 may supply the display panel 100 with a data signal (for example, sensing data signal) for detecting characteristics of the pixel PX.

In some embodiments, the data driver 400 may generate a data signal (or a data voltage) corresponding to a data value (or gradation value) included in the compensated image data CDATA by using gamma voltages. Here, the gamma voltages may be generated by the data driver 400, or may be provided from a separate gamma voltage generating circuit (for example, a gamma integrated circuit). In addition, gamma voltages corresponding to a length of an active sensing period may be stored in the gamma unit/gamma voltage driver (to be described later) during one frame, and these gamma voltages may be provided from the gamma voltage driver to the data driver 400. The data driver 400 may select one of gamma voltages based on a data value, and may output the selected gamma voltage as a data signal.

The sensing driver 500 may calculate characteristic values of the pixels PX based on sensing values provided from the sensing lines SSL, and may generate a compensation value for compensating for the characteristic values of the pixels PX. For example, the sensing driver 500 may detect and compensate for a change in a threshold voltage Vth of a drive transistor included in the pixel PX, a change in mobility, and a change in one or more characteristics of a light emitting element.

In some embodiments, during the data write period, the sensing driver 500 may supply the display panel 100 with an initialization voltage (e.g., a predetermined initialization voltage) VINT for displaying an image through the sensing lines SSL. In addition, during a sensing period, the sensing driver 500 may receive a current or a voltage extracted from the pixel PX through the sensing lines SSL. The extracted current or voltage corresponds to a sensing value, and the sensing driver 500 may detect a change in one or more characteristics of a drive transistor based on the sensing value.

The sensing driver 500 may calculate a compensation value for compensating for input image data DATA based on the detected change in characteristics. The compensation value may be provided to the timing controller 600, and the timing controller 600 may generate compensated image data CDATA. In some embodiments, the compensation value may be provided to the data driver 400. In addition, in some embodiments, the display device may include a separate compensation unit/compensation driver, and the compensation driver may also generate a compensation value by receiving a sensing value extracted from the sensing driver 500.

The timing controller 600 may receive a control signal CTL and the input image data DATA from an image source such as an external graphic device. The timing controller 600 may generate the data control signal DCS, the scan control signal SCS, and the emission control signal ECS in response to the control signal CTL supplied from the outside. The data control signal DCS generated by the timing controller 600 may be supplied to the data driver 400, the scan control signal SCS may be supplied to the scan driver 200, and the emission control signal ECS may be supplied to the emission control driver 300.

In addition, the timing controller 600 may supply the data driver 400 with the compensated image data CDATA based on the externally supplied input image signal IDATA. The input image data IDATA and the compensated image data CDATA may include gradation information included in a gradation range set in the display device.

The timing controller 600 may further control an operation of the sensing driver 500. For example, the timing controller 600 may control timing when a reference voltage (or initialization voltage) is supplied to the pixels PX through the sensing lines SSL and/or timing when a current generated by the pixels PX through the sensing lines SSL.

Although FIG. 1 illustrates that the sensing driver 500 has a configuration that is different from the timing controller 600, at least a part of the configuration of the sensing driver 500 may be included in the timing controller 600. For example, the sensing driver 500 and the timing controller 600 may be configured as one drive integrated circuit. Furthermore, the data driver 400 may also be included in the timing controller 600. Accordingly, at least some of the data driver 400, the sensing driver 500, and the timing controller 600 may be implemented as one drive integrated circuit in other embodiments.

Hereinafter, a pixel of a display device according to some embodiments will be described with reference to FIGS. 2 to 5.

Figure 2:
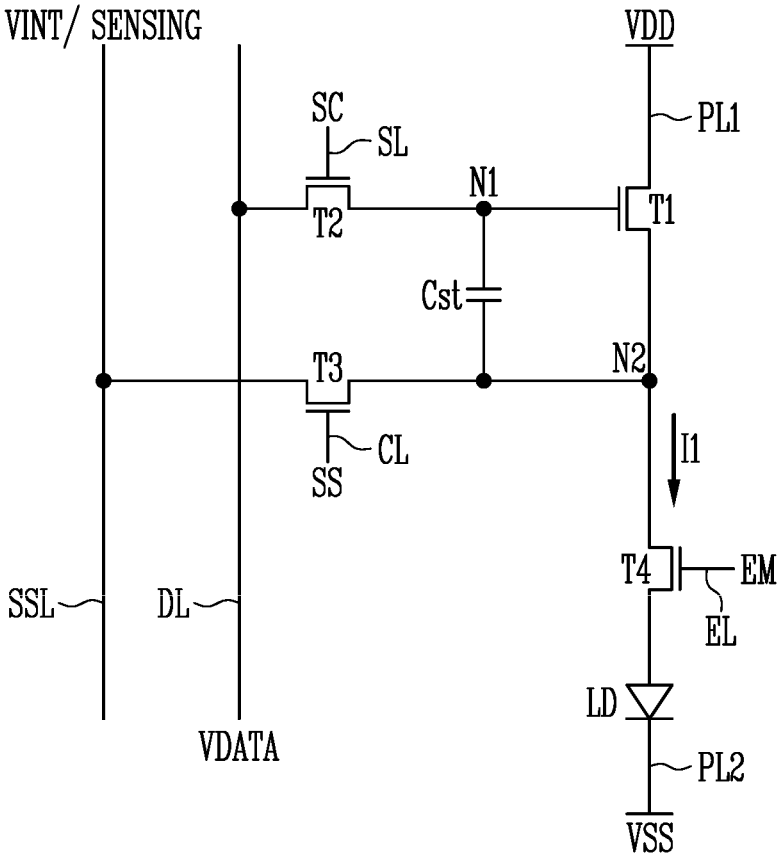
FIG. 2 is a circuit diagram illustrating electrical connection of one pixel in a display device according to some embodiments.
Figure 3:
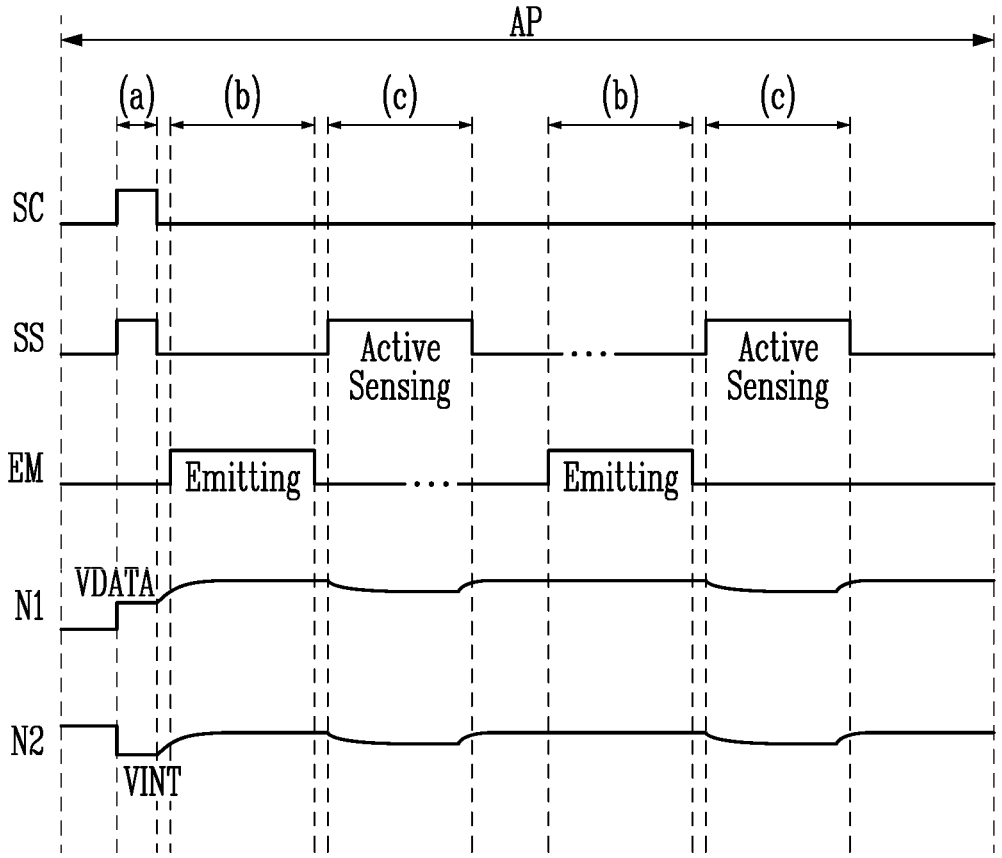
FIGS. 3 and 4 are timing diagrams illustrating an example of an operation of the one pixel illustrated in FIG. 2.
Figure 4:
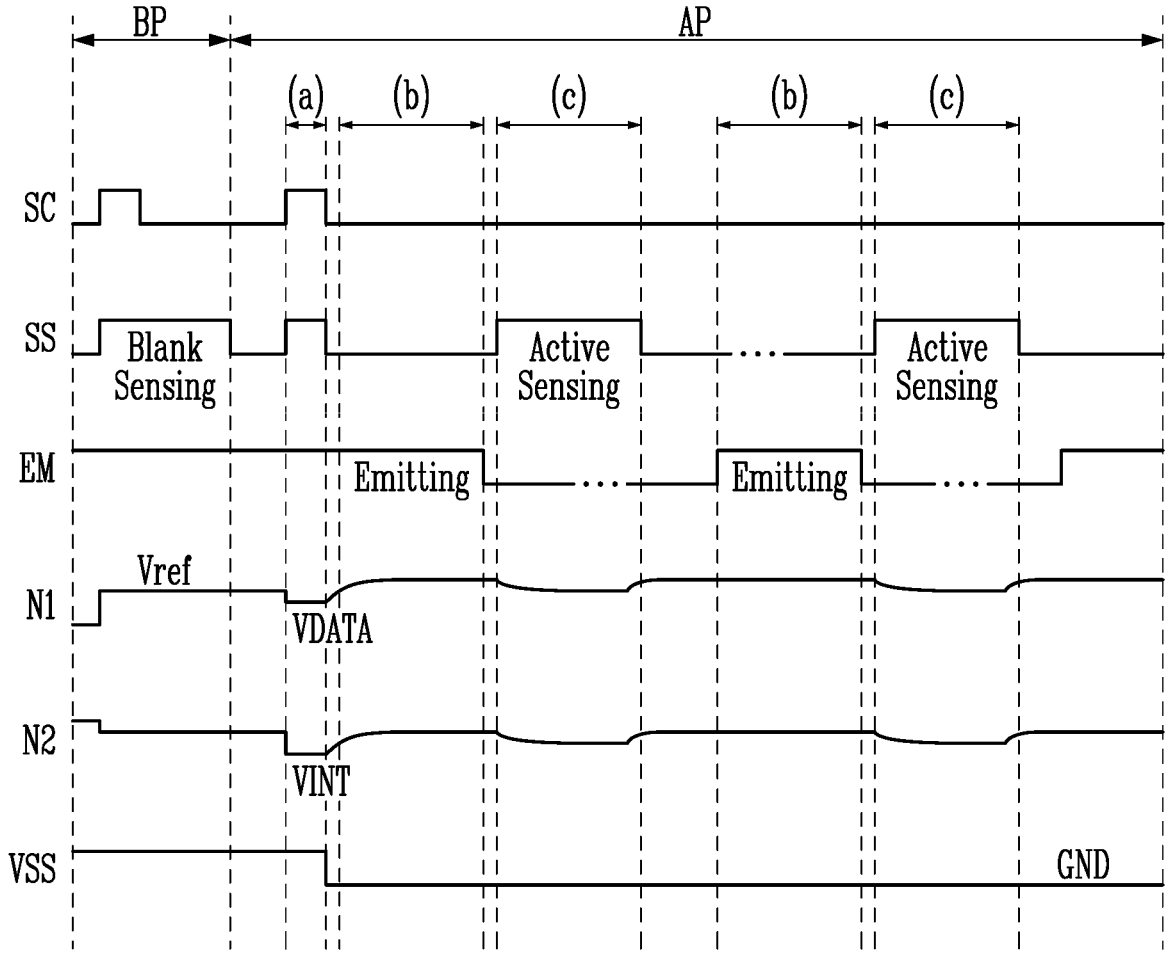
Figure 5:
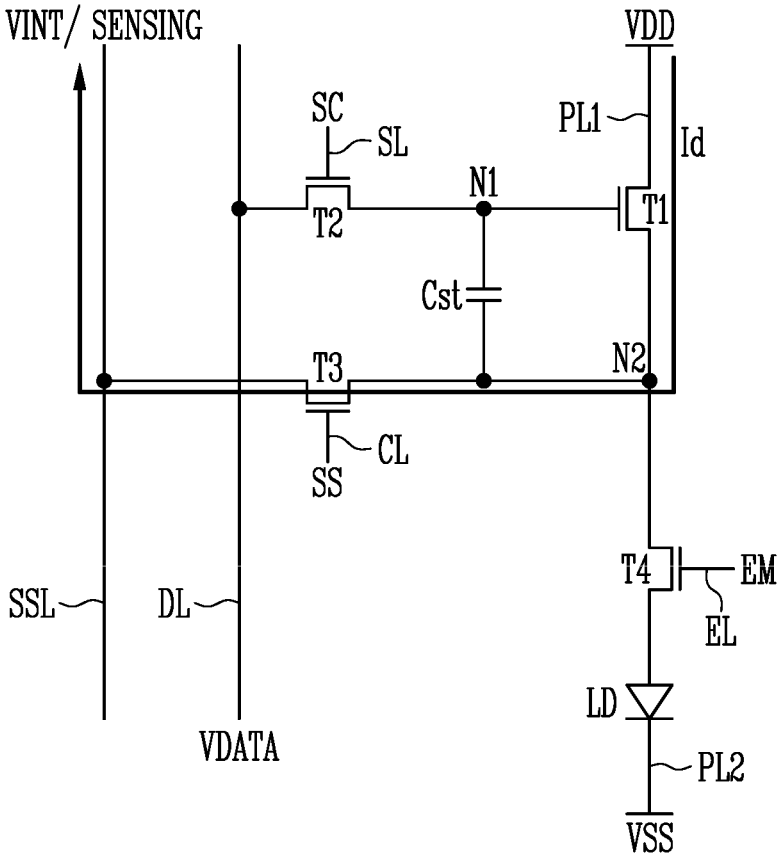
FIG. 5 is a circuit diagram illustrating an example of an operation of a sensing period of the one pixel illustrated in FIG. 2.

FIG. 2 is a circuit diagram illustrating an electrical connection of one pixel in a display device according to some embodiments, FIGS. 3 and 4 are timing diagrams illustrating an example of an operation of one pixel illustrated in FIG. 2, and FIG. 5 is a circuit diagram illustrating an example of an operation of a sensing period of the one pixel illustrated in FIG. 2.

Referring to FIG. 2, the pixel PX may include a light emitting element LD, a first transistor T1, a second transistor T2, a third transistor T3, a fourth transistor T4, and a storage capacitor Cst.

A first electrode of the light emitting element LD is connected to a second electrode of the fourth transistor T4, and a second electrode of the light emitting element LD is connected to a second power line PL2. A second drive voltage VSS may be applied to the second electrode of the light emitting element LD through the second power line PL2. The light emitting element LD generates light (e.g., light of a predetermined luminance) in response to the amount of a drive current I1 supplied from the first transistor T1. In some embodiments, the first electrode of the light emitting element LD may be an anode, and the second electrode thereof may be a cathode.

A first electrode of the first transistor T1 (or driving transistor) may be connected to a first power line PL1, and a second electrode thereof may be connected to a second node N2. A gate electrode of the first transistor T1 may be connected to a first node N1. A first drive voltage VDD may be applied to the first electrode of the first transistor T1 through the first power line PL1. The first transistor T1 may control the amount of the drive current I1 flowing to the light emitting element LD through the fourth transistor T4 in response to a voltage difference between the first node N1 and the second node N2.

A first electrode of the second transistor T2 may be connected to the data line DL, and a second electrode thereof may be connected to the first node N1. A gate electrode of the second transistor T2 may be connected to the first scan line SL. The second transistor T2 may be turned on when the first scan signal SC is supplied to the first scan line SL to transfer data voltage VDATA from the data line DL to the first node N1.

The third transistor T3 may be connected between the sensing line SSL and the second electrode of the first transistor T1 (or the second node N2). A gate electrode of the third transistor T3 may be connected to the second scan line CL. The third transistor T3 may be turned on when the second scan signal SS is supplied to the second scan line CL to electrically connect the sensing line SSL to the second node N2 (or to the second electrode of the first transistor T1).

In some embodiments, when the third transistor T3 is turned on, the initialization voltage VINT may be supplied to the second node N2. In addition, when the third transistor T3 is turned on, a current generated by the first transistor T1 may be supplied to the sensing driver 500 via the sensing line SSL.

A first electrode of the fourth transistor T4 may be connected to the second node N2, and the second electrode thereof may be connected to the first electrode of the light emitting element LD. A gate electrode of the fourth transistor T4 may be connected to the emission control line EL. The fourth transistor T4 may be turned on when the emission signal EM is supplied to the emission control line EL to transmit a current corresponding to the drive current I1 applied from the second electrode of the first transistor T1 (or from the second node N2) to the first electrode of the light emitting element LD.

The storage capacitor Cst may be connected between the first node N1 and the second node N2. During the data write period, the storage capacitor Cst may store a voltage corresponding to a voltage difference between the data voltage VDATA applied to the first node N1 and the initialization voltage VINT applied to the second node N2.

Meanwhile, a circuit structure of the pixel PX in the present disclosure is not limited to the structure illustrated in FIG. 2. For example, the light emitting element LD may also be located between the first power line PL1 and the first electrode of the first transistor T1 in other embodiments.

In addition, although a transistor is illustrated as an NMOS in FIG. 2, the present disclosure is not limited thereto. For example, at least one of the first to fourth transistors T1, T2, T3, and T4 may be configured with a PMOS transistor.

Referring to FIGS. 2 to 5, the pixels PX in the display device according to some embodiments may be driven in a data write period (a), an emission period (b), and an active sensing period (c) included in an active period AP within one frame.

In some embodiments, the data write period (a), the emission period (b), and the active sensing period (c) may be defined as one frame. In addition, in some embodiments, the data write period (a), the emission period (b), the active sensing period (c), and a blank period BP may be defined as one frame. Here, the blank period BP may correspond to a period between one frame and the next frame. However, the present disclosure is not limited thereto.

FIG. 3 mainly illustrates the data write period (a), the emission period (b), and the active sensing period (c) in one frame, and FIG. 4 illustrates both the active period AP and the blank period BP in one frame.

The active period AP may include the data write period (a) in which the data voltage VDATA is applied to the pixel PX, the emission period (b) "Emitting" in which the light emitting element LD emits light, and the active sensing period (c) "Active Sensing" for sensing characteristic of the first transistor T1. In some embodiments, the active period AP may correspond to an emission period in which the light emitting element LD emits light, or may also correspond to a period in which an image is displayed on the display panel 100.

In the data write period (a), as the first scan signal SC of a high level is applied to the first scan line SL, the second transistor T2 is turned on. Accordingly, the data voltage VDATA is applied to the first node N1.

As the second scan signal SS of a high level is applied to the second scan line CL, the third transistor T3 is turned on. Accordingly, the initialization voltage VINT, which may be a constant voltage, is applied to the second node N2. The first scan signal SC and the second scan signal SS may be concurrently or substantially simultaneously supplied to one horizontal line. Accordingly, a voltage corresponding to a difference between the data voltage VDATA and the initialization voltage VINT may be stored in the storage capacitor Cst. Meanwhile, during the data write period (a), the fourth transistor T4 is turned off, and the light emitting element LD does not emit light.

When the respective supply of the first scan signal SC and the second scan signal SS to the first scan line SL and the second scan line CL is stopped, the second transistor T2 and the third transistor T3 are turned on.

The first transistor T1 may control the amount of the drive current I1 supplied to the light emitting element LD in response to a voltage stored in the storage capacitor Cst.

During the emission period (b), as the emission signal EM of a high level is applied to the emission control line EL, the fourth transistor T4 is turned on. Accordingly, the light emitting element LD may emit light with a luminance corresponding to the drive current I1 of the first transistor T1 applied through the fourth transistor T4. Meanwhile, during the emission period (b), the second transistor T2 and the third transistor T3 are turned off.

As the drive current I1 is applied to the fourth transistor T4 and the light emitting element LD, a voltage of the second node N2 may be gradually changed to a voltage that is higher than the initialization voltage VINT. A voltage of the first node N1 may be gradually changed to a voltage that is higher than the data voltage VDATA according to the voltage of the second node N2 due to the storage capacitor Cst.

During the active sensing period (c) "Active Sensing", as the second scan signal SS of a high level is applied to the second scan line CL, the third transistor T3 is turned on. The second transistor T2 and the fourth transistor T4 are turned off. Accordingly, the active sensing period (c) may be a non-emission period in which the light emitting element LD does not emit light.

As the fourth transistor T4 is turned off, a current flowing through the first transistor T1 flows through the second node N2 and the third transistor T3 to the sensing line SSL. Even when the second transistor T2 is turned off, a current may flow through the first transistor T1 according to a voltage stored in the storage capacitor Cst. This current may be the sensing current Id illustrated in FIG. 5. That is, in some embodiments, the active sensing period (c) may be a period for sensing one or more characteristics of the first transistor T1 through the sensing current Id flowing through the first transistor T1.

During the active sensing period (c), the sensing current Id, or ID, that is generated through the first transistor T1 may correspond to following Equation 1.

$$I_D = \mu_p C_{ox} \frac{W}{2 \times L} (V_{GS} - V_{th})^2 (1 + \lambda V_{DS}) \quad \text{[Equation 1]}$$

Where $\mu_p$ is electron mobility, $C_{ox}$ is gate oxide capacitance per unit width of the gate electrode of the first transistor T1, W is a width of the gate electrode of the first transistor T1, L is a length of the gate electrode of the first transistor T1, and λ corresponds to a modulation coefficient of a channel length of the first transistor T1. $V_{GS}$ is a voltage difference between a voltage of the gate electrode of the first transistor T1 (or the first node N1) and a voltage of the second electrode (or the second node N2), and Vth corresponds to a threshold voltage of the first transistor T1. $V_{th}$ may be a value sensed in the previous frame. $V_{DS}$ is a voltage difference between the first electrode and the second electrode of the first transistor T1.

Accordingly, a change in mobility of the first transistor T1 may be recognized through the sensing current Id/$I_D$. The sensing current Id/$I_D$ may be applied to the sensing driver 500 through the sensing line SSL, the sensing driver 500 may detect a change in mobility of the first transistor T1 through the sensing current Id/$I_D$, and a compensation value may be calculated based on the detected change value. The compensation value may be provided to the timing controller 600 to be used as a value for compensating the pixel PX.

In some embodiments, the display device may be driven to include at least one active sensing period (c) within the active period AP. As the active sensing period (c) is driven, the display device may update characteristic information of the first transistor T1 in real time, and thus, fast compensation may be performed. Accordingly, the display device may effectively reduce spots and afterimages.

Although some embodiments describe that the display device includes two active sensing periods (c) within the active period AP of one frame, the present disclosure is not limited thereto. In some embodiments, the number of active sensing periods (c) may be variously changed.

Referring to FIGS. 2 to 5 again, the pixels PX in the display device according to some embodiments may be driven in the blank period BP, the data write period (a), the emission period (b), and the active sensing period (c) within one frame.

The blank period BP may include a blank sensing period, and the blank sensing period may be a sensing period for sensing characteristics of the first transistor T1 before the data write period (a). For example, the blank sensing period may be a period in which a change in threshold voltage and/or mobility of the first transistor T1 is sensed.

During the blank sensing period, the second transistor T2 and the third transistor T3 are turned on. In this case, the reference data voltage Vref is applied to the data line DL connected to the first electrode of the second transistor T2, and the second transistor T2 is turned on, and thereby, the reference data voltage Vref is applied to the first node N1. In addition, as the third transistor T3 is turned on, the initialization voltage VINT is applied to the second node N2.

The emission signal EM of a high level is applied to the emission control line EL, but the light emitting element LD does not emit light as a high voltage is applied as the second drive voltage VSS.

A current flowing through the first transistor T1 is applied to the second node N2. That is, even when the second transistor T2 is turned off, the second node N2 maintains the reference data voltage Vref, and a sensing current flows through the first transistor T1 according to the voltage stored in the storage capacitor Cst. The sensing current may flow to the sensing line SSL through the third transistor T3 that is turned on longer than the second transistor T2. Accordingly, the sensing driver 500 may detect a threshold voltage and/or a mobility change value of the first transistor T1 through the sensing current, and may calculate a compensation value based on the detected change value.

In some embodiments, as the active sensing period (c) (that is, non-emission period) is included in the active period AP, the emission period (b) and the non-emission period of the display device are repeated several times, and thereby, power consumption may be increased. Accordingly, in some embodiments, when a still image is displayed in a plurality of frames for an amount of time (e.g., a predetermined or threshold time or longer), or when a change in mobility of the first transistor T1 sensed during the blank sensing period is greater than a corresponding mobility change (e.g., a preset or threshold change in mobility), after the blank sensing period within the blank period BP in a frame, the display device may be driven to include the active sensing period (c) within the active period AP of the display device.

Hereinafter, a method of driving a display device will be described in detail with reference to FIGS. 6 and 7.

Figure 6:
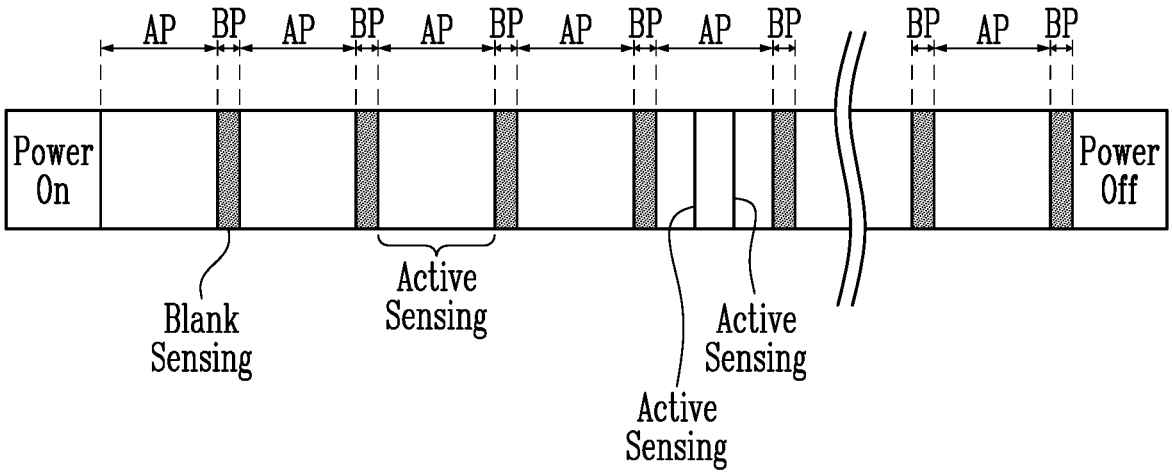
FIG. 6 is a conceptual diagram illustrating a method of driving a display device according to some embodiments.
Figure 7:
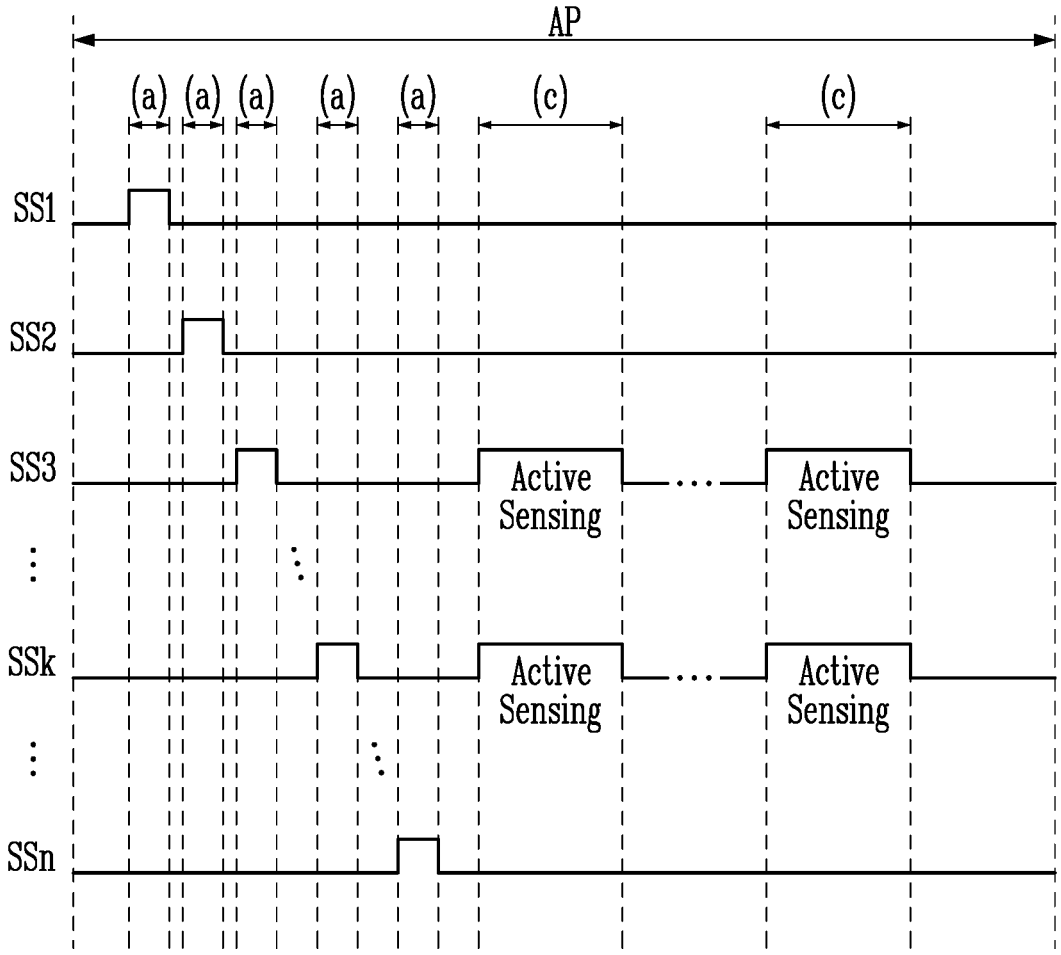
FIG. 7 is a timing diagram illustrating a method of driving a display device according to some embodiments.

FIG. 6 is a conceptual diagram illustrating a method of driving a display device according to some embodiments, and FIG. 7 is a timing diagram illustrating the method of driving the display device according to some embodiments.

Referring to FIG. 6, a display device according to some embodiments may display an image through a plurality of frames while power of the display device is on before the power is off. One rectangle illustrated in FIG. 6 indicates one frame including at least one pixel row PXR (see FIG. 1).

In some embodiments, one frame may include only the active period AP. In addition, there may be a blank period BP between the active period AP of one frame and the active period AP of the next frame. For example, the blank period BP may be located between the active period AP of the first frame and the active period AP of the next frame after power is on.

As illustrated in FIG. 6, during the blank period BP prior to the active period AP of the second frame, deterioration characteristics of the pixel PX that may occur according to an image display of the first frame may be sensed and compensated. For example, the blank period BP may include a blank sensing period (see FIGS. 3 and 4) for sensing a change in mobility of the first transistor T1 included in the pixel PX. In this case, in the display panel 100 in which the plurality of pixels PX are arranged in a horizontal direction to constitute one pixel row PXR, the display device may extract a sensing value corresponding to one pixel row PXR, and may generate compensated image data CDATA (see FIG. 1).

Thereafter, an image is displayed through the next frame, and the image data CDATA compensated during the blank period BP may be applied in the next frame.

In some embodiments, after a plurality of frames are displayed, when a still image is displayed on a plurality of frames of the display device for an amount of time (e.g., a predetermined or threshold amount of time) or longer, or when a change in mobility of the first transistor T1 which is sensed during a blank sensing period is greater than a corresponding mobility change (e.g., a preset or threshold mobility change), a frame after the blank sensing period may be driven so that the active sensing period (c) (see FIGS. 3 and 4) is included in the active period AP of the display device.

In addition, in some embodiments, the display device may also be driven so that blank sensing is not performed during the blank period BP and only the active sensing period (c) is included in the active period AP.

During the active period AP, all the pixel rows PXR of one frame may be driven to include the active sensing period (c). After the one frame elapses, in some embodiments, the active sensing period (c) may be omitted from the active period AP in the next frame.

In addition, in some embodiments, during the active period AP, as few as one pixel row PXR of one frame may be driven to include the active sensing period (c). That is, only one pixel row PXR may be driven to include the data write period (a), the emission period (b) (see FIGS. 3 and 4), and the active sensing period (c), while the other pixel rows PXR may be driven to include only the data write period (a) and the emission period (b).

However, it should be noted that more than one and fewer than all pixel rows PXR of one frame may be driven to include the active sensing period (c), while the other pixel rows PXR may be driven to include only the data write period (a) and the emission period (b). For example, one frame including n pixel rows PXR may be driven so that only two pixel rows PXR include the active sensing period (c).

Referring to FIG. 7, one frame includes n pixel rows PXR extending in the horizontal direction. A 2-1$^{th}$ second scan signal SS1 may be applied to a 2-1$^{th}$ scan line of the first pixel row PXR, and a 2-2$^{th}$ second scan signal SS2 may be applied to a 2-2$^{th}$ scan line of the second pixel row PXR. A 2-3$^{th}$ second scan signal SS3 may be applied to a 2-3$^{th}$ scan line of the third pixel row PXR. A 2-k$^{th}$ second scan signal SSk may be applied to a 2-k$^{th}$ scan line of the kth pixel row PXR, and a 2-n$^{th}$ second scan signal SSn may be applied to a 2-n$^{th}$ scan line of the nth pixel row PXR.

As the second scan signals SS1 to SSn are sequentially applied to the plurality of second scan lines, the pixel rows are sequentially driven from the first pixel row PXR to the data write period (a). In the present example, during the active period AP, the active sensing period (c) is driven in the third pixel row PXR and the k$^{th}$ pixel row PXR. The other pixel rows PXR are driven so as not to include the active sensing period (c). In the same embodiments, the emission period (b) (see FIGS. 3 and 4) may be driven after the data write period (a).

That is, in the present example, during the active period AP, only two pixel rows PXR of one frame may be driven to include the active sensing period (c). In this case, when the active sensing period (c) is included in the active period AP in the next frame, at least one pixel row PXR that does not include the active sensing period (c) in the current frame (e.g., one or more of the first pixel row PXR, the second pixel row, and/or the n$^{th}$ pixel row PXR) may be driven to include the active sensing period (c).

In addition, for all pixel rows PXR to be driven to include the active sensing period (c), the active period AP may be driven to include the active sensing period (c) in a plurality of respective frames. For example, when at least one pixel row PXR is driven to include the emission period (b) and the active sensing period (c) in the first frame, the other pixel rows PXR may be driven to include only the emission period (b) in the first frame. In addition, in the second frame, at least one of the other pixel rows PXR may be driven to include the emission period (b) and the active sensing period (c). In the second frame, the other pixel rows PXR other than the at least one pixel row PXR may be driven to include only the emission period (b).

Before the power is off, during the blank period BP, a threshold voltage of the first transistor T1 included in the pixel PX of one frame may be sensed by blank sensing, and a sensing value may be provided for data voltage compensation of a subsequent frame. In this case, the compensated image data CDATA (see FIG. 1) may also be generated by extracting a sensing value from all of the pixel rows PXR of one frame displaying an image on the display panel 100.

In some embodiments, as the active sensing period (c) is included in the active period AP, the emission period (b) (see FIGS. 3 and 4) and the non-emission period of the display device are repeated several times, and thereby, a luminance may be reduced. Accordingly, in some embodiments, to keep a display luminance constant, a gamma voltage table corresponding to a length of the active sensing period (c) may be included during one frame. Driving of the display device to keep the display luminance constant will be described below with reference to FIGS. 8 to 10.

Figure 8:
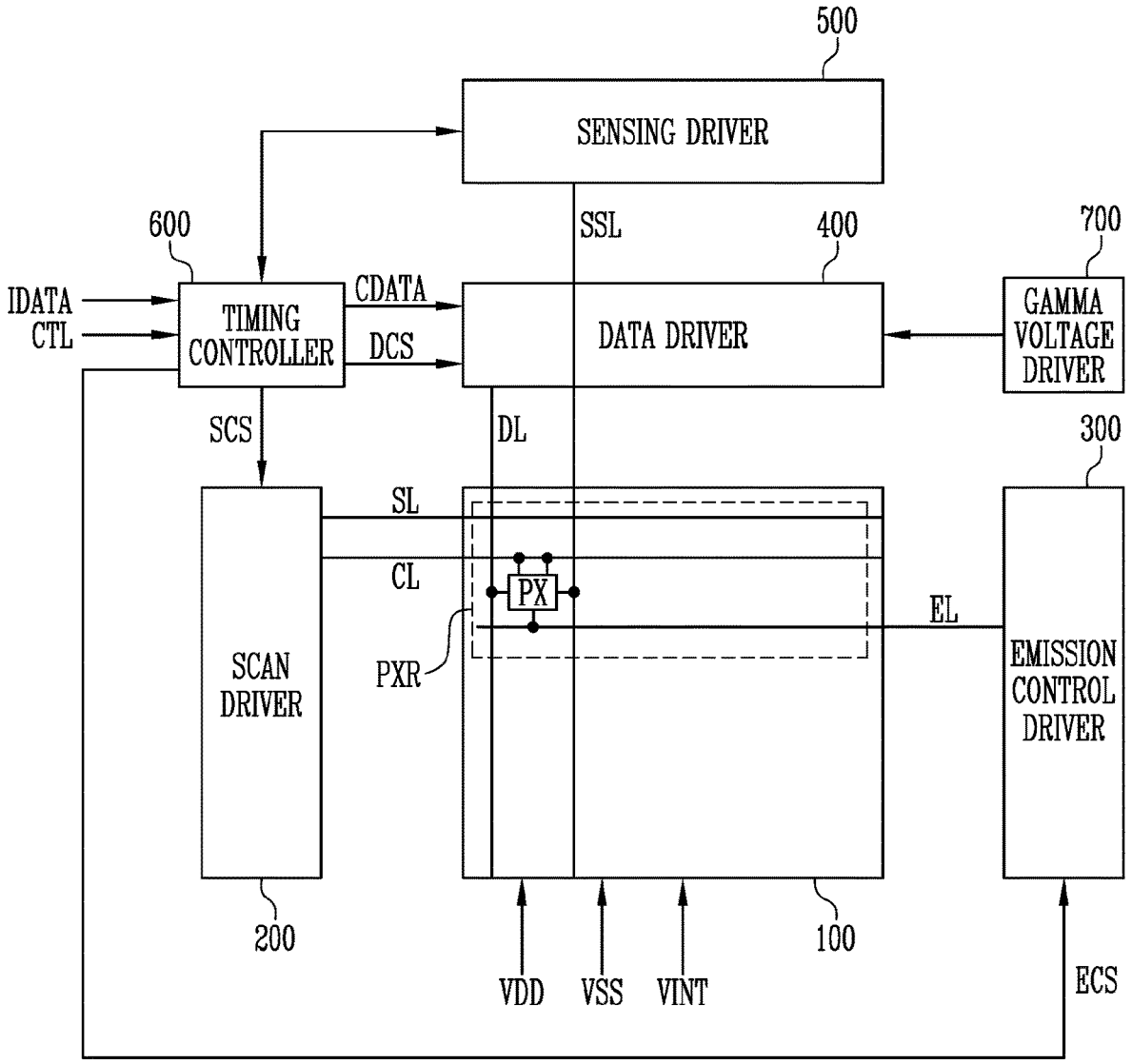
FIG. 8 is a block diagram schematically illustrating a display device according to some embodiments.
Figure 9:
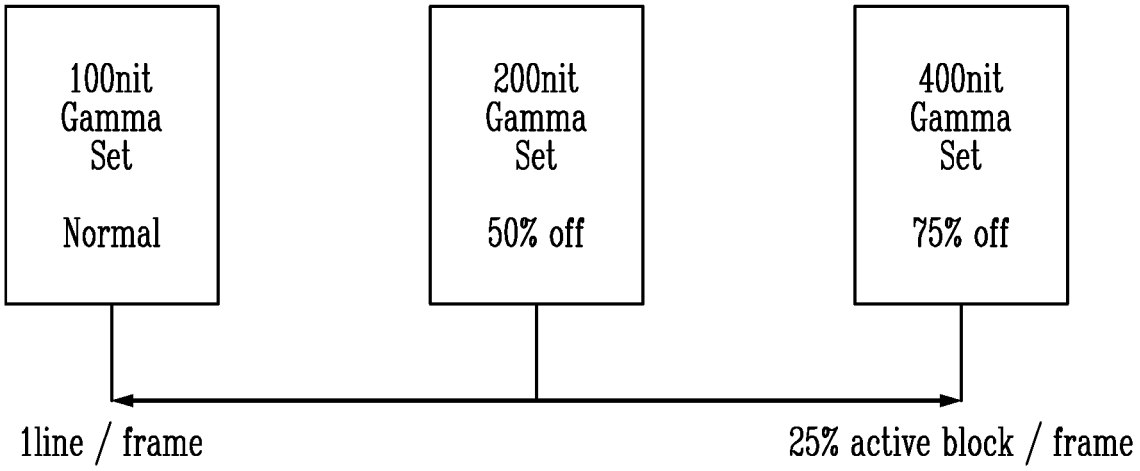
FIG. 9 is a conceptual diagram illustrating a gamma voltage table stored in a gamma unit/gamma voltage driver of a display device according to some embodiments.
Figure 10:
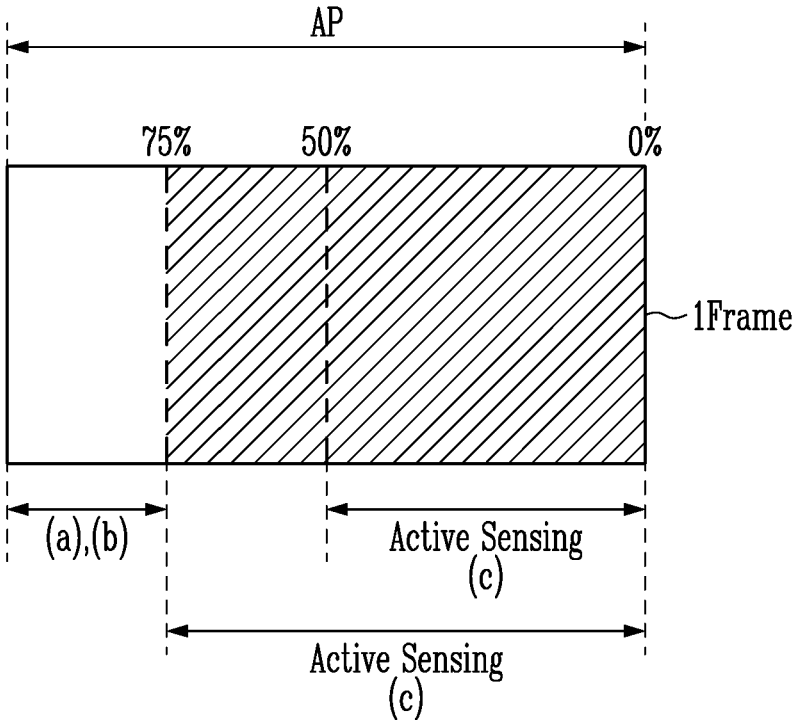
FIG. 10 is a conceptual diagram illustrating a method of driving a display device according to some embodiments.

FIG. 8 is a schematic block diagram of a display device according to some embodiments, FIG. 9 is a conceptual diagram illustrating a gamma voltage table stored in a gamma voltage driver in a display device according to some embodiments, and FIG. 10 is a conceptual diagram illustrating a method of driving a display device according to some embodiments.

First, referring to FIG. 8, a display device according to some embodiments may include the display panel 100, the scan driver 200, the emission control driver 300, the data driver 400, the sensing driver 500, the timing controller 600, and a gamma unit/gamma voltage driver 700. Because the display device illustrated in FIG. 8 is similar to the display device illustrated in FIG. 1, a difference therebetween will be mainly described hereinafter. In addition, the pixel PX illustrated in FIG. 8 may correspond to the pixel PX of FIG. 2 described above, and the pixel PX illustrated in FIG. 8 may be driven by the method of FIGS. 3 to 7 described above.

The display panel 100 may include a plurality of pixels PX, and the plurality of pixels PX may be sensed on a pixel block basis during the active sensing period (c). The pixel block includes at least one pixel row PXR among the pixel rows PXR arranged in a horizontal direction.

The scan driver 200 may supply a second scan signal to the second scan lines CL, and the second scan signal may be used to sense a drive current flowing through the pixel PX.

The data driver 400 may receive gamma voltages from the gamma voltage driver 700, may select one of the gamma voltages based on a data value included in the compensated image data CDATA, and may output a data signal. Here, the gamma voltages may be values for determining a display luminance.

The gamma voltage driver 700 may store a gamma voltage table for compensating for a data voltage in correspondence with a length of the active sensing period (c) during one frame. The gamma voltage driver 700 may provide the stored gamma voltages to the data driver 400.

An example of the gamma voltage table stored in the gamma voltage driver 700 will be described with reference to FIGS. 9 and 10.

Referring to FIGS. 9 and 10, it can be seen that a gamma voltage varies according to the active sensing period (c) during the active period AP. During one frame, a portion of the active period AP other than the active sensing period (c) may be a data write period (a) and/or an emission period (b).

For example, when at least one pixel row PXR is driven to include one active sensing period (c) during the active period AP of one frame 1Frame, at least one pixel row PXR to be sensed may receive a gamma voltage corresponding thereto. That is, at least one pixel row PXR may have one active sensing period (c) in a normal mode, and in this case, a gamma voltage corresponding to approximately 100 nits may be applied.

In addition, when at least one pixel row PXR is driven to include multiple active sensing periods (c) during the active period AP of the one frame 1Frame, at least one pixel row PXR to be sensed may receive a gamma voltage corresponding thereto. For example, when at least one pixel row PXR is driven to include 50% of the active sensing period (c) during the active period AP of the one frame 1Frame, a gamma voltage corresponding to approximately 200 nits may be applied to the pixel row PXR to be sensed. In addition, and for example, when at least one pixel row PXR is driven to include 75% of the active sensing period (c) during the active period AP of the one frame 1Frame, a gamma voltage corresponding to approximately 400 nits may be applied to the pixel row PXR to be sensed.

In the display device according to some embodiments, to prevent a display luminance from being reduced due to non-emission of the pixels PX (or pixel rows PXR) sensed during the active sensing period (c), a gamma voltage may be applied to the pixels PX (or pixel rows PXR) sensed according to a length of the active sensing period (c). For example, as the length of the active sensing period (c) is increased in one frame 1Frame, a magnitude of the gamma voltage applied to the pixels PX (or pixel rows PXR) to be sensed may be increased.

Accordingly, in some embodiments, even when an active sensing period is included in an active period, a gamma voltage corresponding to a length of the active sensing period may be reflected in pixel rows to be sensed during one frame, and thus, a display luminance may be kept constant.

Although the above description is made with reference to embodiments of the present disclosure, those skilled in the art or those of ordinary skill in the relevant technical field will understand that various modifications and changes may be made to the present disclosure within the scope not departing from the idea and technical scope of the present disclosure described in the claims to be described below.

Therefore, the technical scope of the present disclosure should be determined by the claims without being limited to the content described in the detailed description of the specification, with functional equivalents of the claims to be included therein.

What is claimed is:

1. A display device comprising:

pixels divided into pixel rows arranged in a horizontal direction, and comprising a light emitting element, and a first transistor for applying a drive current to the light emitting element; and a sensing driver configured to receive a sensing value extracted from one or more of the pixels, wherein at least one pixel row of the pixel rows is configured to be driven in one frame comprising an emission period in which the light emitting element emits light after a data voltage is applied to the pixels, and an active sensing period for sensing a characteristic of the first transistor after the data voltage is applied to the pixels.

2. The display device of claim 1, wherein others of the pixel rows are configured to be driven to comprise only the emission period in the one frame.

3. The display device of claim 1, wherein, when a still image is displayed for a threshold amount of time or longer during a plurality of frame periods, a frame after the still image is driven so that the at least one pixel row comprises the emission period and the active sensing period.

4. The display device of claim 3, wherein at least one of the plurality of frame periods comprises a blank sensing period for sensing the characteristic of the first transistor.

5. The display device of claim 4, wherein, when a change in mobility of the first transistor sensed during the blank sensing period is greater than a threshold mobility change, a frame after the blank sensing period is driven to comprise the emission period and the active sensing period.

6. The display device of claim 5, wherein the sensing driver is configured to detect a change in a threshold voltage and a change in mobility of the first transistor by using a sensing value sensed during the blank sensing period, and to calculate a compensation value based on the detected change.

7. The display device of claim 1, further comprising:

a data driver configured to apply the data voltage to the pixels; and a timing controller configured to supply the data driver with image data compensated based on externally supplied input image data.

8. The display device of claim 7, wherein the sensing driver is configured to detect a mobility change of the first transistor by using a sensing value sensed during the active sensing period, and to calculate a compensation value based on the detected mobility change, and wherein the timing controller is configured to generate compensated image data by reflecting the compensation value provided from the sensing driver.

9. The display device of claim 7, further comprising a gamma voltage driver configured to store a gamma voltage table for compensating for the data voltage in correspondence with a length of the active sensing period during the one frame.

10. The display device of claim 9, wherein the sensing driver is configured to detect a mobility change of the first transistor by using a sensing value sensed during the active sensing period, and to calculate a compensation value based on the detected mobility change, and wherein the timing controller is configured to generate compensated image data by reflecting the compensation value provided from the sensing driver.

11. A display device comprising:

pixels divided into pixel rows arranged in a horizontal direction, and comprising a light emitting element, and a first transistor for applying a drive current to the light emitting element; and a sensing driver configured to receive a sensing value extracted from the pixels, wherein at least one pixel row of the pixel rows is configured to be driven to comprise an emission period in which the light emitting element emits light after a data voltage is applied to the pixels, and an active sensing period for sensing a characteristic of the first transistor after the data voltage is applied to the pixels during a first frame, wherein other pixel rows of the pixel rows are driven to comprise only the emission period in the first frame, and wherein at least one of the other pixel rows is driven to comprise the emission period and the active sensing period in a second frame.

12. The display device of claim 11, wherein others of the other pixel rows are configured to be driven to comprise only the emission period in the second frame.

13. The display device of claim 11, wherein the sensing driver is configured to detect a mobility change of the first transistor by using a sensing value sensed in the active sensing period.

14. A method of driving a display device comprising a display panel comprising pixel rows of pixels arranged in a horizontal direction, and a sensing driver configured to receive sensing values extracted from the pixels, the method comprising:

driving at least one pixel row of the pixel rows to comprise an emission period in which a light emitting element emits light after a data voltage is applied, and an active sensing period for sensing a characteristic of a first transistor after the data voltage is applied to the pixels during one frame, wherein the pixels comprise:

a light emitting element;

the first transistor configured to apply a drive current to the light emitting element, connected between a second node and a first power line for receiving a first drive voltage, and comprising a gate electrode connected to a first node;

a second transistor configured connected between a data line and the gate electrode of the first transistor, and comprising a gate electrode connected to a first scan line;

a third transistor connected between a sensing line and the second node, and comprising a gate electrode connected to a second scan line;

a fourth transistor connected between the second node and the light emitting element, and comprising a gate electrode connected to an emission control line; and a switching capacitor connected between the gate electrode of the first transistor and the second node.

15. The method of claim 14, wherein the second transistor and the third transistor are configured to be in a turn-off state, and the fourth transistor is configured to be turned on, during the emission period.

16. The method of claim 14, wherein the second transistor and the fourth transistor are configured to be in a turn-off state, and the third transistor is configured to be turned on, during the active sensing period.

17. The method of claim 14, wherein the sensing driver is configured to extract a sensing value corresponding to a current flowing to the second node through the first transistor during the active sensing period.

18. The method of claim 14, wherein at least one frame period of a plurality of frame periods comprises a blank sensing period for sensing the characteristic of the first transistor.

19. The method of claim 18, wherein the second transistor and the third transistor are configured to be turned on during the blank sensing period.

20. The method of claim 19, wherein, when a change in mobility of the first transistor sensed during the blank sensing period is greater than a threshold mobility change, a frame after the blank sensing period comprises the emission period and the active sensing period.

* * * * *